United States Patent [19]

Lee

[11] Patent Number: 4,955,579

[45] Date of Patent: Sep. 11, 1990

[54] CONCRETE FORMING DEVICE WITH CORNER FORMING ACCESSORY

[76] Inventor: Yuan-Ho Lee, 851, Chong-San Rd., Nan-Pao Tsun, Kuei-Jen Hsian, Tainan Hsieng, Taiwan

[21] Appl. No.: 370,753

[22] Filed: Jun. 23, 1989

[51] Int. Cl.[5] ..... E04G 11/38; E04G 17/16

[52] U.S. Cl. ..... 249/19; 249/23; 249/193; 249/210; 249/219.1

[58] Field of Search ..... 249/1, 13, 18, 19, 20, 249/23, 27, 28, 50, 189, 192–194, 207, 209, 211, 212, 219.1, 210; 277/DIG. 6

[56] References Cited

U.S. PATENT DOCUMENTS

| | | | |
|---|---|---|---|
| 1,452,983 | 4/1923 | Rath | 249/28 |
| 3,121,933 | 2/1964 | Dragunas | 249/189 |
| 3,523,671 | 8/1970 | Torrellas | 249/219.2 |
| 3,610,565 | 10/1971 | Okazaki | 249/194 |
| 3,993,720 | 11/1976 | Burdett | 249/20 |
| 4,192,623 | 3/1980 | Borg | 249/211 |
| 4,742,985 | 5/1988 | Mathis | 249/17 |
| 4,813,690 | 3/1989 | Corburn, Jr. | 277/205 |

FOREIGN PATENT DOCUMENTS

| | | | |
|---|---|---|---|
| 1174544 | 8/1985 | U.S.S.R. | 249/18 |
| 1195712 | 6/1970 | United Kingdom | 249/18 |

*Primary Examiner*—James C. Housel

*Attorney, Agent, or Firm*—Ladas & Parry

[57] ABSTRACT

A forming device for forming a ceiling in which a neat corner is to be formed between the ceiling and an adjacent wall which includes a form panel to form a portion of the ceiling adjacent to the wall, having an engaging projection formed on a back face thereof, the engaging projection having a flange extendeing therefrom in a direction substantially parallel to the back face to confine an engaging groove. A filler member is placed between the vertical wall and the edge of the form panel. A form holding member is set up with a portion substantially parallel to the form panel adjacent to the wall. A filler holding member is mounted on that portion of the form holding member and includes a first portion substantially parallel to the form panel and a second portion perpendicular to the first portion. The first portion is slideably secured to the form holding member, and the second portion extends adjacent to the vertical wall. The second portion has a depressing portion to press the filler member against the second concrete structure and an angled mortise portion to engage with the groove of the form panel.

6 Claims, 2 Drawing Sheets

CONCRETE FORMING DEVICE WITH CORNER FORMING ACCESSORY

BACKGROUND OF THE INVENTION

This invention relates to a concrete forming device and particularly to a concrete forming device which includes a filler member to be placed between a form panel and a concrete wall which forms a corner with the panel as well as a filler holding member to hold the filler member tightly against the wall.

Conventionally, a concrete ceiling or floor is formed by arranging form panels horizontally and establishing a form holding assembly to support the form panels, as shown in FIG. 1. By the conventional method, it is difficult to obtain a concrete ceiling which forms a neat corner with an adjacent vertical wall, because a concrete flash F is usually formed along edges formed by the ceiling and a vertical wall as shown in FIG. 2. This phenomenon is due to the fact that concrete leaks through the gap which is inevitably found between the horizontal form panel and the adjacent vertical wall when the horizontal form panel is not positioned tightly against the vertical wall. In common practice, the resulting concrete flash is removed manually, thereby consuming both time and labor.

SUMMARY OF THE INVENTION

An object of the invention is to provide a forming device for forming a ceiling or floor without concrete flash at a edges adjacent to a vertical wall.

The present invention, a forming device for forming a first concrete structure such as a ceiling or floor in which a nest edge is to be formed between the first concrete structure and an adjacent wall, approximately perpendicular to first concrete structure, comprises a form panel to form a portion of the first concrete structure adjacent to said second concrete structure, having engaging projections formed on a back face thereof, the engaging projections, having flanges extending from the projection in a direction substantially parallel to the back face, the flange confining a groove with the back face which opens toward the second concrete structure. A filler member is placed between the second concrete structure and the edge of the form panel. A form holding means is set up with a portion substantially parallel to the form panel adjacent to the second concrete structure. A filler holding means is mounted on that portion of the form holding means and includes a first portion substantially parallel to the form panel and a second portion perpendicular to the first portion. The first portion is slidably secured to the form holding means, and the second portion extends adjacent to the second concrete structure. The second portion has a depressing portion to press the filler member against the second concrete structure and an angled mortise portion to engage with the groove of the form panel. A means is provided for positioning the first portion of the filler holding member relative to the parallel support of the form holding means when the filler holding member is in a proper position.

The filler holding member may be a one piece extruded member which is made of a material selected from the group consisting of aluminum and plastics. The filler member is made of a resilient material such as an ethyl vinyl acetate resin.

The present exemplary preferred embodiment will be described in detail with reference to the accompanying drawings, in which:

DETAILED DESCRIPTION OF THE PREFERRED EMBODIMENT

Figure 1:
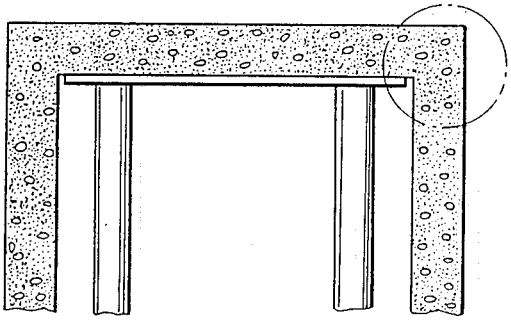
FIG. 1 PRIOR ART
FIG. 1 shows a portion of a forming device in the prior art.
Figure 2:
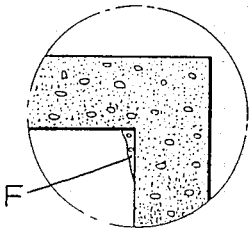
FIG. 2 PRIOR ART
FIG. 2 shows a concrete flash formed at a corner between the ceiling and the vertical wall.
Figure 4:
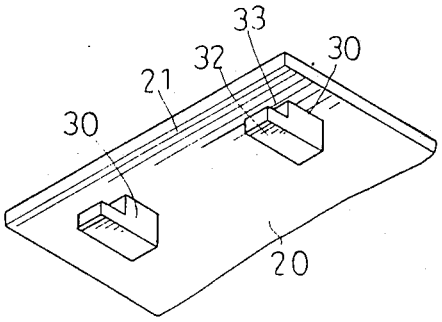
FIG. 4 shows a form panel of the forming device of the invention.
Figure 3:
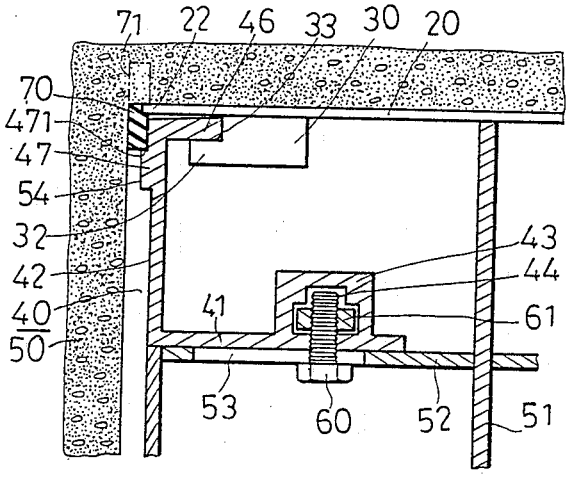
FIG. 3 shows a portion of a forming device incorporating the present invention.

FIGS. 3 to 6 illustrate portions of a forming device for forming a ceiling or floor which incorporates the present invention. Referring to FIGS. 3 and 4, the forming device includes a form panel 20 which is to be placed adjacent to a vertical wall 50 so as to form a portion of a ceiling or floor adjacent to the vertical wall 50. To the back face 21 of the form panel 20 are secured a plurality of engaging projections 30. Each engaging projection 30 has a flange 32 which extends horizontally to confine a groove 33 with the back face of the form panel 20. The groove 33 opens toward the edge of the form panel adjacent to vertical wall 50.

The form panel 20 is a modular panel unit to be assembled with other modular panel units (not shown) to form a complete form panel assembly, and is to be arranged adjacent to a vertical wall during the forming of a concrete ceiling. A form holding assembly 51 is set up conventionally to support the form panel assembly. To make the form holding assembly 51 cooperate with the present invention, the form holding assembly 51 is provided with a horizontal supports 52 below each form panel unit 20. A slide opening 53 is provided in the horizontal supports 52.

A filler member 70 is clamped between the vertical wall 50 and the edge of the form panel 20 to fill the gap between the edge of the form panel 20 and the vertical wall. The filler member 70 is made of a resilient material, preferably an ethyl vinyl acetate resin. A portion 71 of the filler member 70 extends upward to a level above the form panel 20 so that the portion 71 will remain in the formed concrete after the forming operation.

Figure 5:
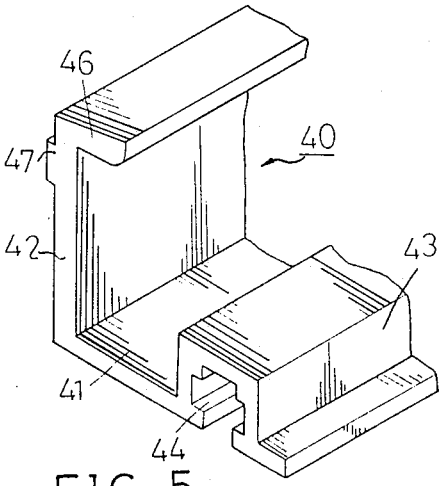
FIG. 5 shows a filler holding member of the forming device of the present invention.
Figure 6:
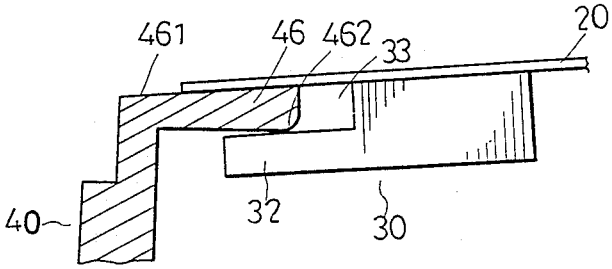
FIG. 6 shows how the mortised portion of the filler holding member is fit in the engaging groove of the flanged engaging projections on the form panel.

Referring to FIGS. 5 and 6 a filler holding member 40 is mounted on the horizontal support 52 of the form holding assembly 51. The filler holding member 40 is a one-piece extruded aluminum or plastic body. The filler holding member 40 includes a horizontal portion 41 and a vertical portion 42. The horizontal portion 41 is provided with an elongated projecting part 43 which confines a groove 44 having a cross-shaped cross-section which opens at the bottom side thereof. As noted above, a slide opening 53 is provided in the horizontal support 52. A nut 61 is located in the groove 44 and a bolt 60 is used to fasten the horizontal portion 41 to the horizontal support 52. The bolt 60 is slideable in the opening 53, thereby enabling the filler holding member 40 to move toward or away from the vertical wall 50. The vertical portion 42 of the filler holding member 40 has a depressing member at an upper end thereof constitued by a depressing portion 47 and a mortise portion 46 which form an angle with the depressing portion. The depresing portion 47 extends along the length of the filler member 70 and abuts with the filler member 70. A shoulder 471 is formed on the depressing portion 47 to retain the filler member 70. The mortise portion 46 can be engaged with the groove 33 of the form panel 20.

In assembly, the form holding asembly 51 is first set up. Filler holding members 40 are mounted on the horizontal supports 52 and the mortise portions 46 are engaged with the grooves 33 of the projection 30. Then, filler members 70 are placed between the vertical wall 50 and the depressing portion 47 and the horizontal portion 41 of the filler holding members 40 are moved along the slide opening 53 until the depressing portions 47 abut tightly against the filler members 70. Finally, form panels are positioned on the form holding assembly.

The mortise portion 46 has an outer face 461 which is slanted upward from the depressing portion to the end portion thereof so as to permit the groove 33 of the form panel to engage with the mortise portion when the form panels are assembled as shown in FIG. 6. The outer space 461 forms and obtuse angle with the depressing portion. The inner face of the mortise portion forms a right angle with the depressing portion. The mortise portion 46 is further provided with a rounded edge 462 so that the edge 462 can be slided smoothly along the surface of the flange 32 until the mortise portion 46 fits in the groove 33.

Since the filler member 70 is resilient, it can be depressed tightly against the vertical wall so that no clearance exists between the vertical wall 50 and the edge of the form panel 20. After the form assembly is set up and the concrete forming operation is completed, the filler member 70 which projects from the informed ceiling is cut away and a neat corner is formed between the ceiling and the vertical wall 50.

With the invention thus explained, it is apparent that various modification and variation can be made without departing from the scope of the invention. It is therefore intended that the invention be limited only as indicated in the appended claims.

What I claim is:

1. The forming device for forming a poured ceiling by which a neat corner is formed between the ceiling and an adjacent wall, said forming device comprising:

a form panel having a portion which has an edge adjacent to the wall, a forming face and a back face;

a plurality of engaging projections formed on said back face and having a flange extending from said projections in a direction substantially parallel to said back face, said flange confining a groove with said back face which opens towards the wall;

a filler member to be placed between the wall and said edge of said form panel;

a form holding means having a portion substantially parallel to said form panel, and adjacent to, but not engaged with the wall;

a filler holding means having a first portion substantially parallel to said form panel and a second portion substantially perpendicular to said first portion, said first portion being slidably secured to said portion of said form holding means, said second portion extending upward adjacent to the wall, and having a depressing portion to depress said filler member against the wall and a mortise portion to engage with said groove of said form panel, said depressing portion and said mortise portion forming an angle therebetween, said mortise portion having an outer face opposing said back face of the said form panel, said outer face being slanted upward from said depressing portion to an end of said mortise portion forming an obtuse angle with said depressing portion; and means for positioning said first portion of said filler holding means relative to said parallel portion of said form holding means when said filler holding means is in a proper position.

2. A forming device as claimed in claim 1, wherein said parallel portion of said form holding means is provided with an adjustment slide opening.

3. A forming device as claimed in claim 2, wherein said positioning means is a screw member which fastens said first portion of said filler holding means to said parallel portion of said form holding means, said screw member being movable along said slide opening.

4. A forming device as claimed in claim 1, wherein said filler holding means is made of a material selected from the group consisting of aluminum and plastic.

5. A forming device as claimed in claim 1, wherein said filler member is made of a resilient material.

6. A forming device as claimed in claim 1, wherein said depressing portion has a shoulder to retain said filler member.

* * * * *